US005280976A

United States Patent [19]

Melyon

[11] Patent Number: 5,280,976

[45] Date of Patent: Jan. 25, 1994

[54] DOOR SECURITY DEVICE

[76] Inventor: Solly Melyon, 7834 Bankside Dr., Houston, Tex. 77071

[21] Appl. No.: 969,335

[22] Filed: Oct. 30, 1992

[51] Int. Cl.[5] ..... E05C 19/18; E05C 1/04

[52] U.S. Cl. ..... 292/292; 292/162; 292/288

[58] Field of Search ..... 292/292, 304, 302, 297, 292/298, 145, 147, 156, 162, 207, 213, 288, 258, 295, 294; 70/54, 55, 56

[56] References Cited

U.S. PATENT DOCUMENTS

| | | | |
|---|---|---|---|
| 3,521,922 | 7/1970 | Bowling | 292/145 |
| 4,161,333 | 7/1979 | Guttman | 292/288 |
| 4,227,724 | 10/1980 | Day | 292/145 |
| 4,482,177 | 11/1984 | Nagy | 292/156 |
| 4,844,519 | 7/1989 | Dagon | 292/302 X |

*Primary Examiner*—Richard E. Moore
*Attorney, Agent, or Firm*—Bill B. Berryhill

[57] ABSTRACT

A security device for preventing the opening of a hinged door surrounded by a door frame and a door jamb. The security device includes a jamb mount attachable to the door jamb and having horizontal guide plates which extend outwardly from the door frame. The device also includes a locking mount which has horizontal guide plates for juxtaposed disposition with the jamb mount guide plates and which are provided with extending arm portions engageable with a side of the door upon attempted opening thereof. A vertical pin member of polygonal cross-section is engageable with corresponding polygonal holes in one or both of the jamb mount and locking mount guide plates locking the jamb mount and locking mount together to prevent opening of the door.

16 Claims, 2 Drawing Sheets

DOOR SECURITY DEVICE

BACKGROUND OF THE INVENTION

1. Field of the Invention

The present invention pertains to security devices. More specifically, the present invention pertains to a security device for preventing opening of a hinged door.

2. Description of the Prior Art

Most doors, particularly those which provide ingress and egress to a house or building, are usually provided with some type of door lock to prevent unauthorized opening of the door. Most of such locks are opened or locked with a key or some other mechanism which is operable from the exterior of the door. While many of these locks are very secure, others may be easily overcome by an intruder. In fact, expert intruders are capable of overcoming most any door lock which is accessible from the exterior of the door.

To provide additional door security, a number of security devices have been developed as supplemental or secondary locks to thwart entry of an intruder even if the primary door lock has been overcome. Most of these secondary or supplemental security devices are operable only from the interior of the space in a house or building for which the door serves as entry. Thus, the security device cannot be tampered with by an intruder on the exterior of the door.

Many of these secondary security locks or devices take the form of a latch or sliding bolt which is manipulated from the interior side of the door by rotating a latch knob or sliding a bolt so that the latch or bolt engages a corresponding latch or bolt receiving slot to prevent the door from opening. Examples of such designs are shown in U.S. Pat. Nos. 1,043,231; 2,469,610; 3,809,415; and 4,673,202. While these designs may be effective in certain situations, some may be overcome by an intruder placing great forces on the edge of the door.

There are a number of other security devices in which a sliding element is provided which is slidingly retractable to allow opening of the door but which slides into a position engaging the edge of the door to prevent opening thereof. Examples of these devices are shown in U.S. Pat. Nos. 3,537,739 and 4,227,724. Most of these security devices are relatively weak and do not provide security against an intruder using some means of applying a great force to the edge of the door.

In more recent years, security devices have been provided of generally two components. One of the components is some type of member which is securely fastened to the door jamb so that it cannot be removed unless the door is opened. A corresponding plate or bar element is provided which engages an extension of the door jamb element to engage the free edge of the door upon attempted opening thereof preventing its opening. Examples of these type of security devices are shown in U.S. Pat. Nos. 3,316,005; 4,958,868; and 5,098,142. Such designs are relatively simple to install and operate and are fairly effective. However, with increasing criminal activity, improvements in these designs are continuously sought.

SUMMARY OF THE PRESENT INVENTION

The present invention provides a security device for preventing the opening of a hinged door surrounded by a door frame and a door jamb. The device includes two major components: a jamb mount and a locking mount. The jamb mount includes a jamb plate having screw holes therein by which the jamb mount may be attached to the door jamb and a frame plate attached to one edge of the jamb plate at substantially a right angle thereto for disposition against the door frame. One or more substantially horizontal guide plates extend outwardly of the frame plate.

The locking mount includes one or more substantially horizontal guide plates for juxtaposed disposition with the jamb mount guide plates. At least one of the locking mount guide plates has an extending arm portion which is engageable with a side of the door near the free edge thereof upon attempted opening of the door. A vertical pin member, of polygonal cross-section, is provided which is either separate from or attached to one of the other major components of the device. The pin member is engageable with a corresponding polygonal hole through at least one of the horizontal guide plates to prevent the locking mount guide plates from moving outwardly from the jamb mount guide plates thereby locking the jamb mount and locking mount together to prevent opening of the door.

In one preferred embodiment of the invention, the jamb mount, locking mount and pin member are all separable members. However, the jamb mount guide plates and locking mount guide plates are provided with corresponding polygonal holes which when aligned allow insertion of the pin member to lock the jamb mount and locking mount together to prevent opening of the door. In another preferred embodiment of the invention, the jamb mount, the locking mount and the pin member are all assembled so that the horizontal guide plates of the jamb mount and locking mount are in juxtaposed and sliding relationship. The pin member is affixed to the guide plates of one of the jamb mount or locking mount and is slidingly engageable with corresponding elongated slots in the other of the jamb mount and locking mount guide plates. This allows the locking mount to slide parallel with the side of the door between an unlocked position in which the arm portion of the locking mount is not engageable with the door and a locked position in which the arm portion is engageable with the side of the door.

The manufacture, installation and operation of the security device of the present invention is relatively simple. While the device is relatively inexpensive and easy to operate, it is very effective. The locking device of the present invention can be overcome only by destroying the door. Many other objects and advantages of the present invention will be understood from reading the description which follows in conjunction with the accompanying drawings.

DESCRIPTION OF PREFERRED EMBODIMENTS OF THE INVENTION

Figure 1:
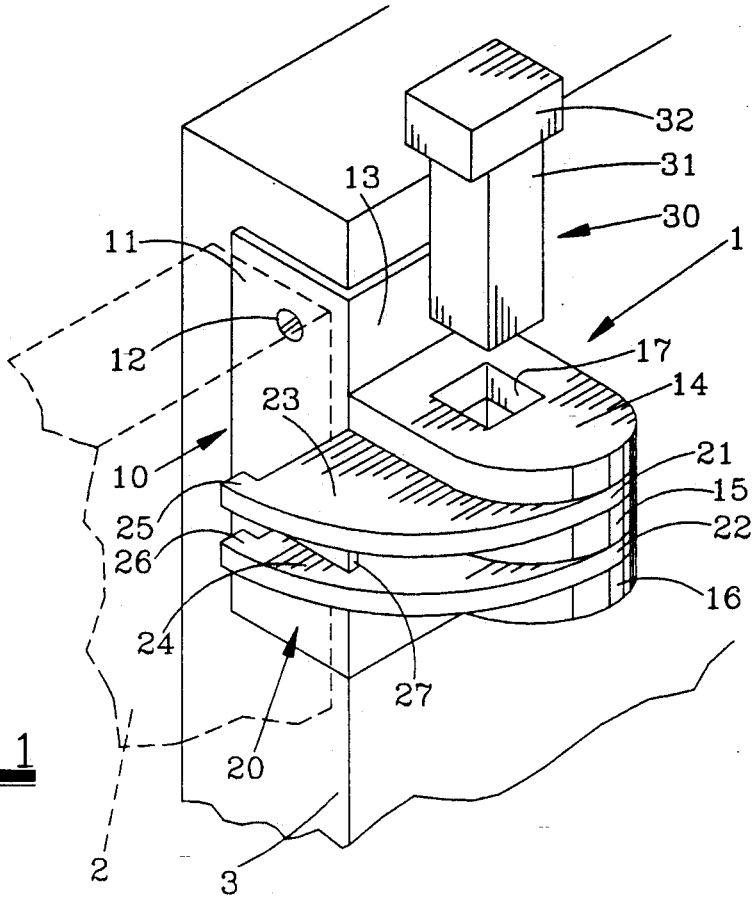
FIG. 1 is a perspective view of a security device for preventing the opening of a door, according to a preferred embodiment of the invention.
Figure 2:
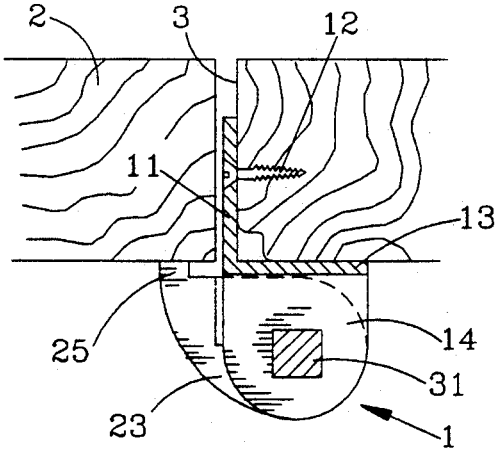
FIG. 2 is a top view of the security device of FIG. 1, partially in section.
Figure 3:
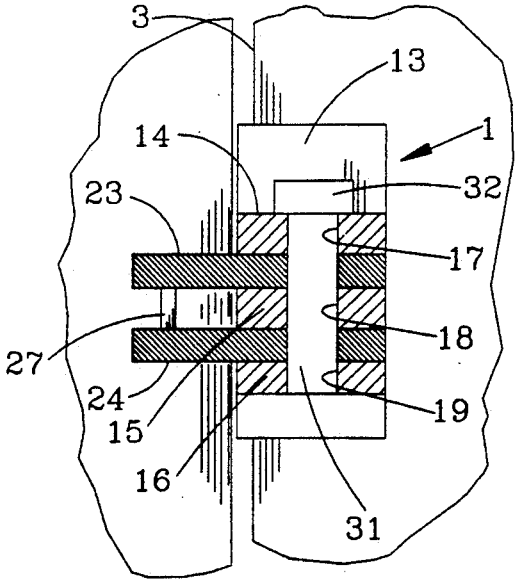
FIG. 3 is an elevation view, partially in section, of the security device of FIGS. 1 and 2.

Referring first to FIGS. 1, 2 and 3 there is shown a security device 1 for preventing the opening of a hinged door 2 surrounded by a door frame having a door jamb 3 which, when the door is closed as shown, is adjacent the free edge of the door opposite the hinged edge (not shown) thereof. The security device 1 is made up of three major components: a jamb mount 10, a locking mount 20 and a locking pin 30.

The jamb mount 10 includes a jamb plate 11 having screw holes therein by which the jamb mount 10 may be attached with screws 12 to the jamb 3. The jamb mount also includes a frame plate 13 attached to one edge of the jamb plate 11 at a substantially right angle thereto for disposition against the door frame. Extending outwardly from the frame plate 13 is one or more (three in the exemplary embodiment) substantially horizontal guide plates 14,15,16. In the exemplary embodiment, these guide plates 14,15,16 are rounded on the outer ends thereof and are fixed with predetermined spaces therebetween. Each of them are also provided with corresponding, aligned polygonal (square in the exemplary embodiment) holes 17, 18 and 19.

The locking mount 20 includes one or more (two in the exemplary embodiment) substantially horizontal guide plates 21,22 for juxtaposed and sliding relationship with the jamb mount guide plates 14, 15 and 16. As shown, each of the locking mount guide plates 21,22 has an extending arm portion 23,24, respectively, which is engageable with the side of the door 2 near the free edge thereof upon attempted opening of the door. In the preferred embodiment the end of the arm portions 23,24 are provided with inwardly directed engagement elements 25,26 for engaging the side of the door 2. The locking mount guide plates 21,22 may be fixed together with a predetermined space therebetween by a connecting rib or support member 27. The spacing of the locking mount guide plates 21 and 22 and the thickness thereof are selected to allow these plates 21,22 to slide into the spaces provided between the jamb mount guide plates 14, 15 and 16. In fact, when the locking device 1 is not in use the locking mount 20 may be completely removed if desired.

The pin member 30 has a body portion 31 the cross-section of which is polygonal. It is selected to correspond with the holes provided through the jamb mount guide plates 14, 15 and 16 and the locking mount guide plates 21,22. Thus, in the exemplary embodiment the pin body 31 is of square cross-section. An enlarged head 32 may also be provided. Thus, it is clear that when the corresponding holes 17,18,19 of the jamb mount and the holes 28,29 of the locking mount are aligned as shown in FIGS. 1, 2 and 3, the pin member 30 may be inserted into these holes locking the jamb mount 10 and locking mount 20 together in the position shown, preventing relative rotation thereof and preventing opening of the door 2.

As previously mentioned, when it is desired that the door 2 not be locked, the pin 30 may be removed and the entire locking mount 20 removed from the assembly by simply sliding it out from the spaces between the jamb mount plates 14, 15 and 16. However, if it is desired that these components be kept together, the pin can be lifted, the locking mount 20 rotated 180 degrees so that the arm portions 23 and 24 project away from the door and the pin 30 reinserted to maintain this non-engageable position until further use is desired.

Figure 4:
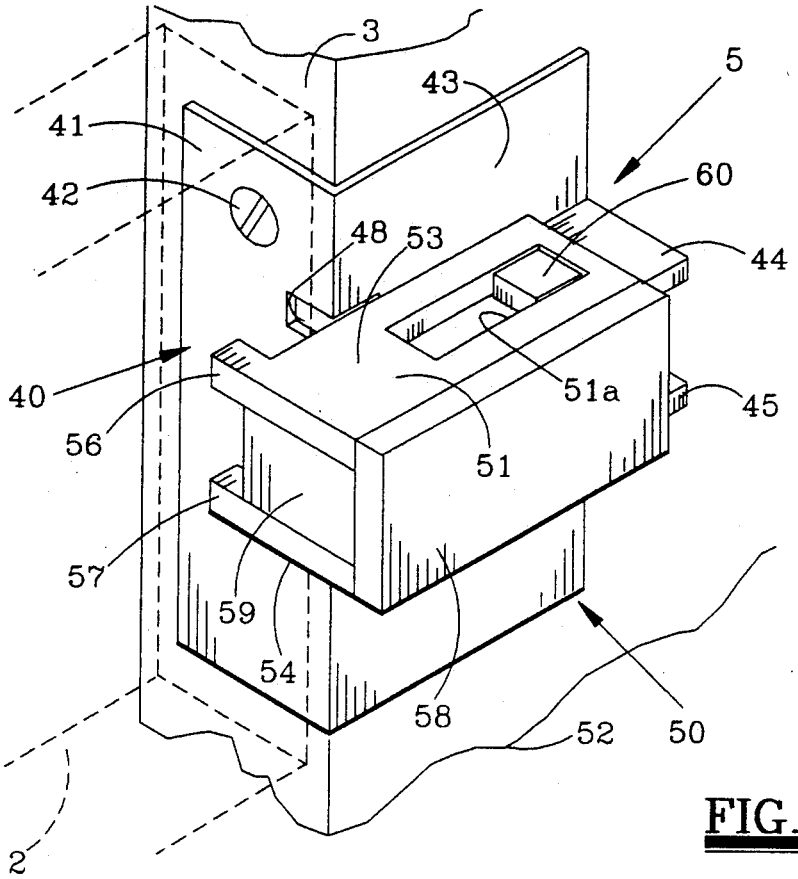
FIG. 4 is a perspective view of a security device for preventing the opening of a door, according to another preferred embodiment of the invention.
Figure 5:
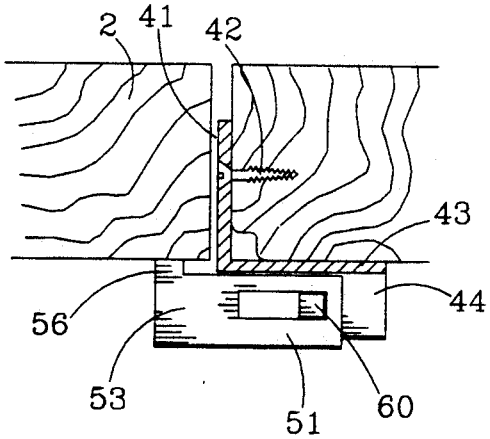
FIG. 5 is a top view of the security device of FIG. 4, partially in section.
Figure 6:
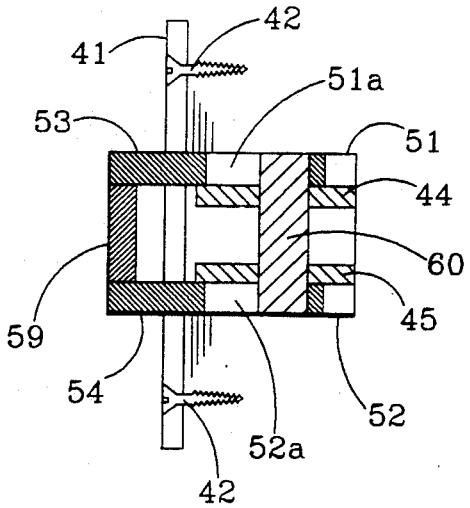
FIG. 6 is an elevation view, partially in section, of the security device of FIGS. 4 and 5.

Referring now to FIGS. 4, 5 and 6 another preferred embodiment of the invention will be described. The security device 5 of this embodiment will be described for use with the same door 2 and door frame which includes door jamb 3 adjacent the free edge of the door 2. This embodiment also includes a jamb mount 40 and a locking mount 50. However, instead of being totally separable as in the previous embodiment, the jamb mount 40 and locking mount 50 are assembled by inter-engagement of pin means 60.

Like in the previously described embodiment, the jamb mount 40 includes a jamb plate 41 having screw holes therein through which screws 42 may be placed for attaching the jamb mount to the door jamb 3. The jamb mount 40 also includes a frame plate 43 attached to one edge of the jamb plate 41 at substantially a right angle thereto for disposition against the door frame. Extending outwardly from the frame plate 43 are a pair of horizontal guide plates 44,45 which in the exemplary embodiment are essentially rectangular in shape. These plates 44,45 are fixed with a predetermined space therebetween.

The locking mount 50 includes one or more substantially horizontal guide plates 51,52 for juxtaposed and sliding relationship with the jamb mount guide plates 44,45. The guide plates 51,52 may be said to have extending arm portions 53,54 which are engageable with the interior side of the door 2 near the free edge thereof upon attempted opening thereof. If desired, these arm portions 53 and 54 ma be provided with inwardly directed engagement elements 56,57 for engaging the side of the door. The locking mount guide plates 51,52 may be held in their fixed spaced apart relationship by one or more vertical plates 58,59, etc.

To maintain the assembled sliding relationship between the locking mount 50 and the jamb mount 40 the locking mount guide plates 51,52 are provided with elongated slots 51*a* and 52*a*. In the exemplary embodiment these slots are rectangular in shape. A vertical pin member 60 is affixed to the jamb mount guide plates so that the upper end of the pin member 60 engages slot 51*a* and the lower end of the pin member 60 engages the slot 52*a*. In the exemplary embodiment, the pin member 60 actually extends through holes provided therefor in the jamb mount guide plates 44 and 45 and is of one piece. However, if desired, the pin member 60 could be made as two elements, one short pin projecting upwardly from the jamb member guide plate 44 and a short pin projecting downwardly from the jamb mount guide plate 45. Obviously, several designs could be made. In any event, it is clear that the pin 60 and the slots 51*a*,52*a* are in a slidingly engageable relationship. This allows the locking mount 50 to slide parallel with the side of the door 2 between an unlocked position, in which the arm portions 53,54 of the locking mount are retracted and not engageable with the side of the door, and a locked position, such as the position illustrated in FIGS. 4, 5 and 6 in which the arm portions are engageable with the side of the door to prevent the opening thereof. To allow the locking mount 50 to slide as far as possible (to the right in the exemplary embodiment) for non-engagement, recesses 48 may be provided in jamb mount plate 41 for receiving the engaging elements 56 and 57 of the locking mount 50.

Thus in the embodiment of FIGS. 4, 5 and 6, the locking mount 50 slides, in relationship to the jamb mount 40, between a non-engaging or unlocked position and the engaging or locked position illustrated in FIGS. 4, 5 and 6. When it is desired that the door 2 not be locked, the locking mount 50 is simply moved to the non-engaging or unlocked position.

Thus, the security device of the present invention provides secondary or supplementary locking which prevents the opening of a door even if the primary door lock is tampered with or overcome by an intruder. The security device of the present invention is installed on the interior side of the door and attached to the jam in such a way that it is almost impossible to tamper with. The security device is extremely strong, simple in manufacture, installation and use and is very effective in preventing unauthorized opening of a door.

Two preferred embodiments of the invention have been described herein. However, many variations of the invention can be made without departing from the spirit thereof. Accordingly, it is intended that the scope of the invention be limited only by the claims which follow.

I claim:

1. A security device for preventing the opening of a hinged door surrounded by a door frame having a door jamb which, when said door is closed, is adjacent the free edge of said door opposite the hinged edge thereof, said device comprising:

a jamb mount which includes a jamb plate having attachment means by which said jamb mount may be attached to said jamb and a frame plate attached to one edge of said jamb plate at substantially a right angle thereto for disposition against said door frame and having one or more substantially horizontal guide plates extending outwardly therefrom;

a locking mount which includes one or more substantially horizontal guide plates for juxtaposed disposition with said jamb mount guide plates, at least one of said locking mount guide plates having an extending arm portion engageable with a side of said door near said free edge thereof upon attempted opening of said door; and a vertical pin member operatively associated with a said jamb mount guide plate of polygonal cross-section engageable with a corresponding polygonal hole through at least one of said horizontal guide plates to prevent said locking mount guide plates from moving outwardly from said jamb mount guide plates thereby locking said jamb mount and said locking mount together to prevent opening of said door.

2. The security device of claim 1 in which all of said guide plates are provided with corresponding alignable polygonal holes engageable by said pin member of corresponding polygonal cross-section to lock said jamb mount and said locking mount together.

3. The security device of claim 2 in which said pin member and the corresponding holes of one of said jamb mount and said locking mount horizontal plates is square, the corresponding holes of the other of said jamb mount and locking mount guide plates being rectangular allowing said locking mount to slide parallel with said side of said door between an unlocked position in which said arm portion of said locking mount is not engageable with said side of said door and a locked position in which said arm portion is engageable with said side of said door.

4. The security device of claim 1 in which there are at least two of said locking mount guide plates which are affixed to each other with a predetermined space therebetween.

5. The security device of claim 4 in which said predetermined space is greater than the thickness of said one or more jamb mount guide plates.

6. The security device of claim 1 in which the end of said arm portion of said locking mount guide plates is provided with an inwardly directed engagement element for engaging said side of said door.

7. A security device for preventing the opening of a hinged door surrounded by a door frame having a door jamb which, when said door is closed, is adjacent the free edge of said door opposite the hinged edge thereof, said device comprising;

a jamb mount which includes a jamb plate having attachment means by which said jamb mount may be attached to said jamb and a frame plate attached to one edge of said jamb plate at substantially a right angle thereto for disposition against said door frame and having one or more substantially horizontal guide plates extending outwardly therefrom;

a locking mount which includes one or more substantially horizontal guide plates for juxtaposed and sliding relationship with said jamb mount guide plates, said locking mount guide plates having an extending arm portion engageable with a side of said door near said free edge thereof upon attempted opening of said door; and a vertical pin member of polygonal cross-section insertable into corresponding alignable polygonal holes provided in both of said jamb mount and said locking mount guide plates to lock said jamb mount and said locking mount together preventing relative rotation thereof to prevent opening of said door.

8. The security device of claim 7 in which there are at least two of said locking mount guide plates which are affixed to each other with a predetermined space therebetween.

9. The security device of claim 7 in which there are at lest two of said jamb mount guide plates which are fixed with predetermined space therebetween.

10. The security device of claim 7 in which the end of said arm portion of said locking mount guide plates is provided with an inwardly directed engagement element for engaging said side of said door.

11. A security device for preventing the opening of a hinged door surrounded by a door frame having a door jamb which, when said door is closed, is adjacent the free edge of said door opposite the hinged edge thereof, said device comprising:

a jamb mount which includes a jamb plate having attachment means by which said jamb mount may be attached to said jamb and a frame plate attached to one edge of said jamb plate at substantially a right angle thereto for disposition against said door frame and having one or more substantially horizontal guide plates extending outwardly therefrom;

a locking mount which includes one or more substantially horizontal guide plates for juxtaposed and sliding relationship with said jamb mount guide plates, said locking mount guide plates having an extending arm portion engageable with a side of said door near said free edge thereof upon attempted opening thereof; and a vertical pin member affixed to at least one of said jamb mount or said locking mount guide plates and slidingly engageable with a corresponding elongated slot in at least one of the other of said jamb mount or said locking mount guide plates allowing said locking mount to slide parallel with said side of said door between an unlocked position in which said arm portion of said locking mount is not engageable with said side of said door and a locked position in which said arm portion is engageable with said side of said door.

12. A security device a set forth in claim 11 in which said pin member is square in cross-section and in which said elongated slot is rectangular.

13. A security device as set forth in claim 11 in which there are at least two of said locking mount guide plates which are fixed at a predetermined space therebetween by a connecting member.

14. A security device as set forth in claim 11 in which there are at least two of said jamb mount guide plates which are fixed at a predetermined space therebetween.

15. A security device as set forth in claim 11 in which the end of said arm portion of said locking mount guide plates is provided with an inwardly directed engagement element for engaging said side door.

16. A security device as set forth in claim 15 in which said jamb mount plate is provided with recess means for receiving said engagement element of said arm portion of said locking mount guide plates when said locking mount is in said unlocked position.

* * * * *